US010011794B2

(12) United States Patent
Funagoshi

(10) Patent No.: US 10,011,794 B2
(45) Date of Patent: Jul. 3, 2018

(54) FLUIDIZED BED SYSTEM AND METHOD FOR OPERATING FLUIDIZED BED FURNACE

(71) Applicant: IHI CORPORATION, Koto-ku (JP)

(72) Inventor: Hiroshi Funagoshi, Tokyo (JP)

(73) Assignee: IHI Corporation, Koto-ku (JP)

( * ) Notice: Subject to any disclaimer, the term of this patent is extended or adjusted under 35 U.S.C. 154(b) by 285 days.

(21) Appl. No.: 14/862,741

(22) Filed: Sep. 23, 2015

(65) Prior Publication Data

US 2016/0010007 A1 Jan. 14, 2016

Related U.S. Application Data

(63) Continuation of application No. PCT/JP2014/061145, filed on Apr. 21, 2014.

(30) Foreign Application Priority Data

Apr. 24, 2013 (JP) ..... 2013-090942

(51) Int. Cl.
*C10J 3/72* (2006.01)
*C10J 3/46* (2006.01)
(Continued)

(52) U.S. Cl.
CPC ..... *C10J 3/726* (2013.01); *C10J 3/466* (2013.01); *C10J 3/482* (2013.01); *C10J 3/485* (2013.01);
(Continued)

(58) Field of Classification Search
CPC ... C10J 3/463; C10J 3/482; C10J 3/485; C10J 3/723; C10J 3/726; C10J 2200/152
See application file for complete search history.

(56) References Cited

U.S. PATENT DOCUMENTS 4,167,918 A * 9/1979 Atabay ..... B01J 8/1818 110/245
4,349,969 A * 9/1982 Stewart ..... B01J 8/1818 110/245
(Continued)

FOREIGN PATENT DOCUMENTS

CN 1081934 A 2/1994
CN 2634306 Y 8/2004
(Continued)

OTHER PUBLICATIONS

Combined Chinese Office Action and Search Report dated Jul. 4, 2016 in Patent Application No. 201480022322.4 (with Partial English Translation of Search Report).
(Continued)

*Primary Examiner* — David J Laux
(74) *Attorney, Agent, or Firm* — Oblon, McClelland, Maier & Neustadt, L.L.P.

(57) ABSTRACT

A fluidized bed system includes a first nozzle group that is provided inside a fluidized bed furnace, a second nozzle group that is provided inside the fluidized bed furnace, a first supply section that supplies a gas into the fluidized bed furnace through the first nozzle group, a second supply section that supplies the gas into the fluidized bed furnace through both the first and second nozzle groups, and a control section that controls the second supply section during a start-up operation to supply the gas into the fluidized bed furnace to form a fluidized bed of a fluid medium inside the fluidized bed furnace, and stops the supply of the gas by the second supply section and controls the first supply section during a normal operation to supply the gas into the fluidized bed furnace to form the fluidized bed of the fluid medium inside the fluidized bed furnace.

6 Claims, 10 Drawing Sheets

(51) Int. Cl.

| | |
|---|---|
| ***C10J 3/48*** | (2006.01) |
| ***F23C 10/20*** | (2006.01) |
| ***F27B 15/02*** | (2006.01) |
| ***F27B 15/10*** | (2006.01) |
| ***F27B 15/18*** | (2006.01) |
| ***F23C 10/10*** | (2006.01) |
| ***F23C 10/32*** | (2006.01) |
| ***F27B 15/20*** | (2006.01) |
| ***F27D 19/00*** | (2006.01) |

(52) U.S. Cl.

CPC ..... *C10J 3/723* (2013.01); *F23C 10/10* (2013.01); *F23C 10/20* (2013.01); *F23C 10/32* (2013.01); *F27B 15/02* (2013.01); *F27B 15/10* (2013.01); *F27B 15/18* (2013.01); *F27B 15/20* (2013.01); *F27D 19/00* (2013.01); *C10J 2200/09* (2013.01); *C10J 2200/152* (2013.01); *C10J 2300/093* (2013.01); *C10J 2300/0916* (2013.01); *C10J 2300/0946* (2013.01); *C10J 2300/0956* (2013.01); *C10J 2300/0976* (2013.01); *C10J 2300/0993* (2013.01); *C10J 2300/1253* (2013.01); *C10J 2300/1807* (2013.01); *F23C 2206/103* (2013.01)

(56) References Cited

U.S. PATENT DOCUMENTS

| | | | | |
|---|---|---|---|---|
| 4,378,206 | A * | 3/1983 | Kullendorff | F23C 10/18 110/263 |
| 4,648,330 | A * | 3/1987 | Delebarre | B01J 8/1818 110/245 |
| 5,014,632 | A * | 5/1991 | Isaksson | B01J 8/44 110/229 |
| 5,183,641 | A * | 2/1993 | Isaksson | B01J 8/44 110/229 |
| 5,372,791 | A | 12/1994 | Abdulally | |
| 5,536,167 | A * | 7/1996 | Yokota | C04B 7/45 432/106 |
| 5,620,488 | A | 4/1997 | Hirayama et al. | |
| 6,709,636 | B1 * | 3/2004 | Oshita | C10J 3/482 422/139 |
| 8,425,638 | B2 * | 4/2013 | Nukumi | C10J 3/463 423/644 |
| 2011/0016789 | A1 | 1/2011 | Nukumi et al. | |

FOREIGN PATENT DOCUMENTS

| | | | |
|---|---|---|---|
| CN | 1566749 | A | 1/2005 |
| CN | 1632380 | A | 6/2005 |
| CN | 101978032 | A | 2/2011 |
| CN | 102042587 | A | 5/2011 |
| JP | A-59-109705 | | 6/1984 |
| JP | A-63-096482 | | 4/1988 |
| JP | A-05-264001 | | 10/1993 |
| JP | A-07-332614 | | 12/1995 |
| JP | A-08-296973 | | 11/1996 |
| JP | A-2000-346310 | | 12/2000 |
| JP | A-2003-172504 | | 6/2003 |
| JP | B-3933105 | | 6/2007 |
| JP | A-2007-170704 | | 7/2007 |
| JP | A-2013-050271 | | 3/2013 |
| WO | WO 2012/066802 | A1 | 5/2012 |

OTHER PUBLICATIONS

International Search Report dated Jun. 3, 2014 in PCT/JP2014/061145 filed Apr. 21, 2014 with English Translation.

* cited by examiner

FLUIDIZED BED SYSTEM AND METHOD FOR OPERATING FLUIDIZED BED FURNACE

This application is a continuation application based on a PCT Patent Application No. PCT/JP2014/061145, filed on Apr. 21, 2014, whose priority is claimed on Japanese Patent Application No. 2013-90942, filed Apr. 24, 2013. The contents of both the PCT Application and the Japanese Application are incorporated herein by reference.

TECHNICAL FIELD

The present disclosure relates to a fluidized bed system and a method for operating a fluidized bed furnace.

BACKGROUND ART

Technologies for generating a gasified gas by gasifying a gasification raw material such as coal, biomass, or tire chips instead of natural gas, the price of which is expected to rise steeply, have been developed in recent years. The gasified gas generated as above is used in power generation systems, production of hydrogen, production of synthetic fuels (synthetic petroleum), production of chemical products such as chemical fertilizers (urea), and the like. Among gasification raw materials which serve as raw materials of the gasified gas, coal in particular can be mined for the next 150 years, which is three times longer than petroleum, and deposit areas thereof are more evenly distributed than those of petroleum, and thus it is expected as one of natural resources that can be stably supplied for a long period of time.

As a technology of gasifying the gasification raw material such as coal, a technology of gasifying a gasification raw material inside a fluidized bed furnace in which a fluid medium forms a fluidized bed using water vapor of about 800° C. (water vapor gasification) has been developed (For example, Patent Document 1).

In addition, with regard to technologies of gasifying the gasification raw material inside the fluidized bed furnace in which the fluid medium forms the fluidized bed, there are Patent Documents 2 and 3 in which nozzles that blow a fluid into a particle layer inside the gasification furnace are provided. In addition, with regard to a technology of a fluidization combustion furnace, there is Patent Document 4.

CITATION LIST

Patent Document

[Patent Document 1]
Japanese Patent No. 3933105
[Patent Document 2]
Japanese Unexamined Patent Application, First Publication No. 2003-172504A
[Patent Document 3]
Japanese Unexamined Patent Application, First Publication No. S59-109705A
[Patent Document 4]
Japanese Unexamined Patent Application, First Publication No. 2007-170704A

SUMMARY

Technical Problem

In a state prior to start-up of a fluidized bed furnace, i.e., a stopped state of the fluidized bed furnace, a fluid medium inside the fluidized bed furnace is at room temperature. Thus, when water vapor is supplied during start-up, water vapor condenses into water in the fluidized bed furnace, and thus the fluid medium is firmly fixed.

Thus, when a start-up operation of the fluidized bed furnace is performed, air is supplied into the fluidized bed furnace to form a fluidized bed, a fluid medium is heated, and thereby the fluid medium is heated up to a temperature at which a normal operation is possible (for example, equal to or higher than the boiling point of water). Then, after the temperature of the fluid medium increases to the temperature at which a normal operation is possible, water vapor is supplied into the fluidized bed furnace for the first time.

Air is supplied into the fluidized bed furnace when a start-up operation of the fluidized bed furnace is performed and water vapor is supplied into the fluidized bed furnace during the normal operation as described above; however, air and water vapor have different pressure losses in supply holes for supplying a gas into the fluidized bed furnace. Specifically, a volume of flow of air necessary for substantially uniformly fluidizing the fluid medium inside the fluidized bed furnace (for forming a fluidized bed) is greater than a volume of flow of water vapor. For this reason, a pressure loss of air in the supply holes becomes greater than a pressure loss of water vapor.

In general, the diameter and number of supply holes are designed on the assumption of a normal operation (in other words, when water vapor is supplied into the fluidized bed furnace). For this reason, taking the pressure loss incurred during the supply of air in a volume of flow necessary for the formation of the fluidized bed into consideration, it is necessary to relatively increase the head of a blower that is used during the start-up operation, and thus an expensive high-output blower should be employed.

Since such a blower that supplies air is used only when a start-up operation of the fluidized bed furnace is performed and not used during the normal operation, use efficiency thereof is low relative to its cost requirement.

The present disclosure takes the above problems into consideration, and aims to provide a fluidized bed system and a method for operating a fluidized bed furnace that can reduce the head of a blower that is used during a start-up operation and can reduce costs required for the blower by reducing the difference between a pressure loss of a gas when the start-up operation of the fluidized bed furnace is performed and a pressure loss of a gas when a normal operation is performed.

Solution to Problem

A fluidized bed system of the present disclosure includes a fluidized bed furnace that contains a fluid medium, a first nozzle group that is provided inside the fluidized bed furnace and constituted by one or a plurality of nozzles having holes for supplying a gas, a second nozzle group that is a nozzle group different from the first nozzle group, is provided inside the fluidized bed furnace, and is constituted by one or a plurality of nozzles having holes for supplying a gas, a first supply section that supplies the gas into the fluidized bed furnace through one of the first nozzle group and the second nozzle group, a second supply section that supplies the gas into the fluidized bed furnace through both the first nozzle group and the second nozzle group, and a control section that controls the second supply section during a start-up operation to supply the gas into the fluidized bed furnace to form a fluidized bed of the fluid medium inside the fluidized bed furnace, and stops the supply of the gas by the second supply section and controls the first supply section during a normal operation to supply the gas into the fluidized bed furnace to form the fluidized bed of the fluid medium inside the fluidized bed furnace.

In addition, in a method for operating a fluidized bed furnace of the present disclosure, when a start-up operation of the fluidized bed furnace that contains a fluid medium is performed, a gas is supplied into the fluidized bed furnace through both a first nozzle group that is provided inside the fluidized bed furnace and constituted by one or a plurality of nozzles having holes, and a second nozzle group that is a nozzle group different from the first nozzle group, is provided inside the fluidized bed furnace, and is constituted by one or a plurality of nozzles having holes to form a fluidized bed of the fluid medium inside the fluidized bed furnace; and when a normal operation of the fluidized bed furnace that contains a fluid medium is performed, the gas is supplied through one of the first nozzle group and the second nozzle group into the fluidized bed furnace to form the fluidized bed of the fluid medium inside the fluidized bed furnace.

In addition, another fluidized bed system of the present disclosure includes a fluidized bed furnace that contains a fluid medium, a plurality of nozzles that are provided inside the fluidized bed furnace and have holes for supplying a gas, a supply section that supplies the gas into the fluidized bed furnace through the plurality of nozzles, and a control mechanism for forming a fluidized bed of the fluid medium inside the fluidized bed furnace by supplying the gas into the fluidized bed furnace during a start-up operation through the plurality of nozzles and for forming the fluidized bed of the fluid medium inside the fluidized bed furnace by supplying the gas into the fluidized bed furnace during a normal operation through, among the plurality of nozzles, specific nozzles that are fewer in number than the nozzles that serve as a supply source of the gas during the start-up operation.

In addition, in another method for operating a fluidized bed furnace of the present disclosure, when a start-up operation of a fluidized bed furnace that contains a fluid medium is performed, a gas is supplied through a plurality of nozzles that are provided inside the fluidized bed furnace having holes into the fluidized bed furnace to form a fluidized bed of the fluid medium inside the fluidized bed furnace, and when a normal operation of the fluidized bed furnace that contains a fluid medium is performed, the gas is supplied through, among the plurality of nozzles, specific nozzles that are fewer in number than the nozzles that serve as a supply source of the gas during the start-up operation into the fluidized bed furnace to form the fluidized bed of the fluid medium inside the fluidized bed furnace.

Advantageous Effects

According to the present disclosure, the head of a blower that is used during a normal operation can be reduced by reducing the difference between a pressure loss of a gas incurred when a start-up operation of a fluidized bed furnace is performed and a pressure loss of a gas incurred when a normal operation is performed. As a result, it is possible to reduce costs required for the blower.

DESCRIPTION OF EMBODIMENTS

Figure 1:
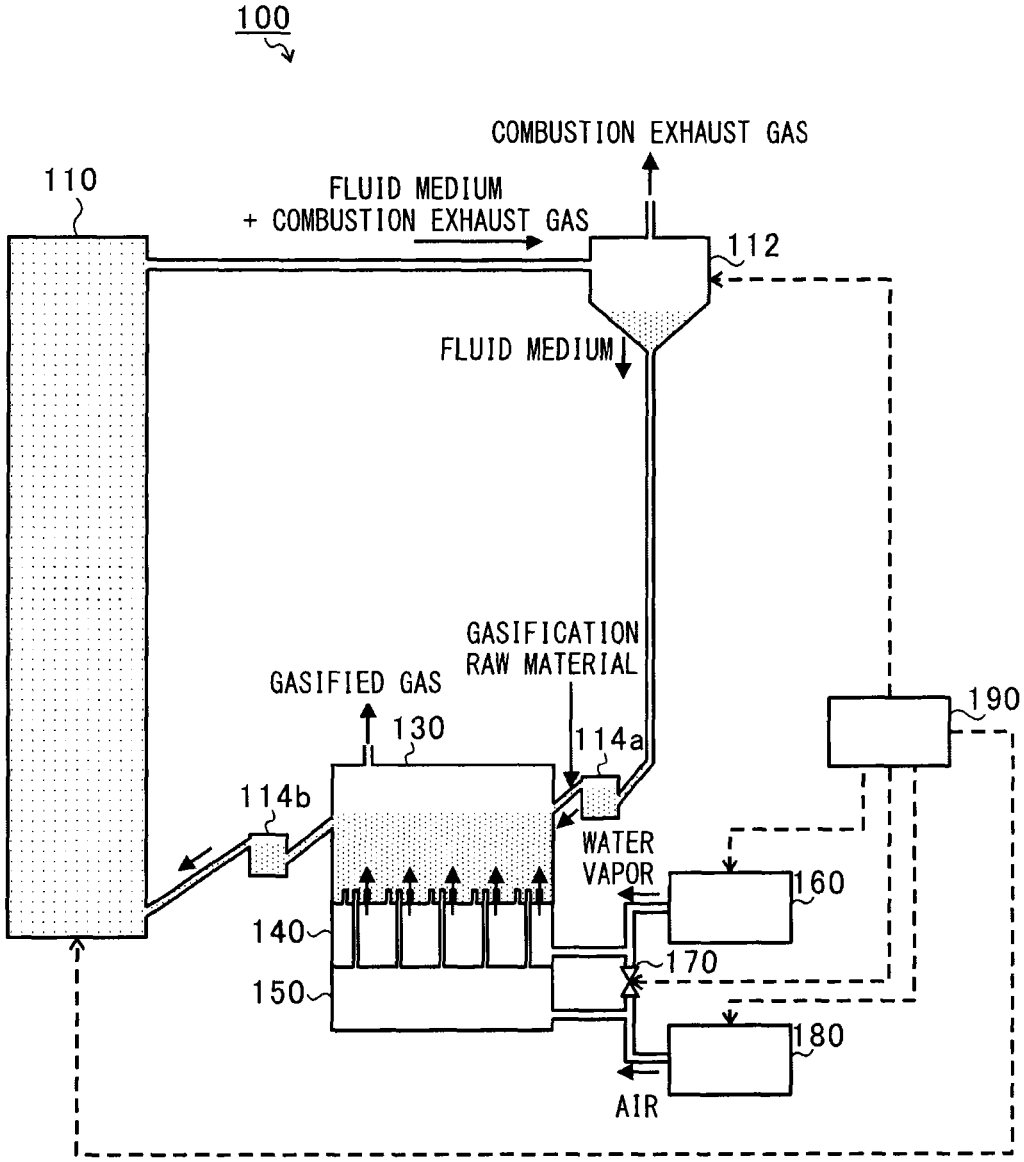
FIG. 1 is a view for describing a specific configuration of a fluidized bed system according to a first embodiment of the present disclosure.

Hereinafter, exemplary embodiments of the present disclosure will be described in detail with reference to the accompanying drawings. Sizes, materials, specific numeric values, and the like shown in the embodiments are merely examples by which the disclosure may be easily understood, and do not limit the present disclosure unless specifically noted. It should be noted that, in the present specification and drawings, the same reference numerals are given to elements that have substantially the same functions and configurations and overlapping description is omitted, and elements that are not directly related to the present disclosure are not illustrated.

First Embodiment: Fluidized Bed System 100

FIG. 1 is a view for describing a specific configuration of a fluidized bed system 100 according to a first embodiment of the present disclosure. As illustrated in FIG. 1, the fluidized bed system 100 is configured to include a combustion furnace 110, a medium separator (cyclone) 112, loop seals 114*a* and 114*b*, a fluidized bed furnace 130, a first wind box 140, a second wind box 150, a first supply section 160, a valve 170, a second supply section 180, and a control section 190. It should be noted that, in FIG. 1, the flows of substances such as a fluid medium, a gasification raw material, a gasified gas, air, water vapor, a combustion exhaust gas, and the like are indicated by solid-lined arrows, and the flows of signals are indicated by dotted-lined arrows.

In the present embodiment, the fluidized bed system 100 is a circulating fluidized bed-type gasification system that circulates a fluid medium including sand such as silica sand having a particle diameter of about 300 μm and the like in the entire system as a heating medium. Specifically, first, the fluid medium is heated to 900° C. to 1000° C. in the combustion furnace 110, and then introduced into the medium separator 112 together with a combustion exhaust gas. In the medium separator 112, the combustion exhaust gas and the high-temperature fluid medium are separated from each other, and the separated combustion exhaust gas undergoes heat recovery in a heat exchanger (for example, a boiler) or the like that is not illustrated.

On the other hand, the high-temperature fluid medium separated in the medium separator 112 is introduced into the fluidized bed furnace 130 via the loop seal 114*a*. The loop seal 114*a* serves to prevent an inflow of a gas (a combustion exhaust gas) from the medium separator 112 to the fluidized bed furnace 130 and an outflow of a gas (a gasified gas or a fluidized gas) from the fluidized bed furnace 130 to the medium separator 112.

The fluid medium introduced from the medium separator 112 into the fluidized bed furnace 130 via the loop seal 114*a* is fluidized by a fluidized gas supplied from one or both of the first wind box 140 and the second wind box 150 to be described later, and then returns to the combustion furnace 110 via the loop seal 114*b*. The loop seal 114*b* serves to prevent an outflow of a gas (a gasified gas or a fluidized gas) from the fluidized bed furnace 130 to the combustion furnace 110 and an inflow of a gas (a combustion exhaust gas) from the combustion furnace 110 to the fluidized bed furnace 130.

As described above, in the fluidized bed system 100 according to the present embodiment, the fluid medium circulates by moving through the combustion furnace 110, the medium separator 112, the loop seal 114*a*, the fluidized bed furnace 130, and the loop seal 114*b* in this order, and then being reintroduced into the combustion furnace 110.

In addition, the first wind box 140 and the second wind box 150 are provided in the lower part of the fluidized bed furnace 130. Furthermore, when the fluidized bed system 100 performs a normal operation, the first supply section 160 is driven, a fluidized gas (water vapor here) supplied from the first supply section 160 is temporarily reserved in the first wind box 140, and then the water vapor reserved in the first wind box 140 is supplied into the fluidized bed furnace 130 from the bottom of the fluidized bed furnace 130. By supplying the water vapor to the high-temperature fluid medium introduced from the medium separator 112 as described above, a fluidized bed (a bubble fluidized bed) is formed inside the fluidized bed furnace 130.

A gasification raw material (a solid raw material) such as coal, biomass, or tire chips is introduced into the fluidized bed furnace 130, then the introduced gasification raw material is gasified by the heat of about 800° C. to 900° C. of the fluid medium, and thereby a gasified gas (synthetic gas) is generated.

Here, to describe the start-up operation and the normal operation of the fluidized bed system 100, in the state prior to start-up of the fluidized bed system 100, i.e., in a stopped state of the fluidized bed system 100, the fluid medium contained in the fluidized bed furnace 130 is at room temperature (for example, 30° C.). Thus, if water vapor is supplied thereto at the start-up, the water vapor condenses into water inside the fluidized bed furnace 130, the fluid medium is firmly fixed due to the water, and thus it is not possible to form a fluidized bed.

Thus, when the start-up operation of the fluidized bed system 100 is performed, first, a fluidized gas such as air that does not condense even at room temperature is supplied to form a fluidized bed inside the fluidized bed furnace 130. Then, the fluid medium rises due to the formation of the fluidized bed, thereby the height in the vertical direction of the fluid medium contained in the fluidized bed furnace 130 increases, then the fluid medium overflows from the fluidized bed furnace 130 and thus is emitted to the loop seal 114*b*, and thereby is introduced into the combustion furnace 110. As described above, when the formation of the fluidized bed is started inside the fluidized bed furnace 130, a circulation of the fluid medium is started.

Next, when an operation of the combustion furnace 110 is started, the temperature of the circulating fluid medium rises. Then, when the temperature of the fluid medium introduced into the fluidized bed furnace 130 reaches a temperature proper for gasification of the gasification raw material (for example, about 800° C. to 900° C.), a fluidized gas to be supplied to the fluidized bed furnace 130 is switched to a gasifying agent (water vapor) for gasifying the gasification raw material, and a normal operation is started.

As described above, air is supplied into the fluidized bed furnace 130 when the start-up operation of the fluidized bed furnace 130 is performed and water vapor is supplied into the fluidized bed furnace 130 during the normal operation; however, air and water vapor have different pressure losses at supply holes for supplying the fluidized gas to the fluidized bed furnace 130. Specifically, the minimum volume of flow of air necessary for forming a fluidized bed of the fluid medium inside the fluidized bed furnace 130 (to set U0/Umf to be equal to or greater than 1) is greater than the minimum volume of flow of water vapor. Here, U0/Umf is an index that indicates a fluidization state of a fluidized bed, and when the U0/Umf is equal to or greater than 1, the fluid medium can be regarded as forming a fluidized bed. It should be noted that U0 is a speed at which a fluid (a fluidized gas) moves inside a fluidized bed, and Umf is a fluidization start speed. The difference in the minimum volume of flow is attributable to a difference in physical properties of air and water vapor (for example, mass density and viscosity), or a difference in temperatures.

As described above, since the minimum volume of flow of air for forming a fluidized bed is greater than the minimum rate of water vapor, a pressure loss of air at the supply hole becomes greater than a pressure loss of water vapor. For example, if air of 30° C. or water vapor of 500° C. is supplied so that the same U0/Umf is gained at supply holes provided with the same hole diameter and in the same number, a pressure loss of the air of 30° C. is, for example, 20 times a pressure loss of the water vapor of 500° C. or greater.

Since the hole diameter and number of supply holes are designed on the assumption of a normal operation (in other words, when water vapor is supplied into the fluidized bed furnace 130), when the pressure loss incurred during supply of air of the volume of flow necessary for the formation of a fluidized bed is taken into account, it is necessary to relatively increase the head of a blower that is used during the start-up operation (for example, to set the head to be about 20 times that of a blower for supplying water vapor). In addition, if the head of the blower is relatively low, desired U0/Umf is not obtained and the state of the fluidized bed becomes unstable.

Thus, by conducting a study on a structure of the supply holes for supplying a fluidized gas to the fluidized bed furnace 130, the difference between the pressure loss of a fluidized gas (air) during the start-up operation and the pressure loss of another fluidized gas (water vapor) during the normal operation in the fluidized bed system 100 according to the present embodiment is reduced. Hereinafter, a mechanism for reducing the difference between the pressure loss of air during the start-up operation and the pressure loss of water vapor during the normal operation will be described in detail.

Figure 2A:
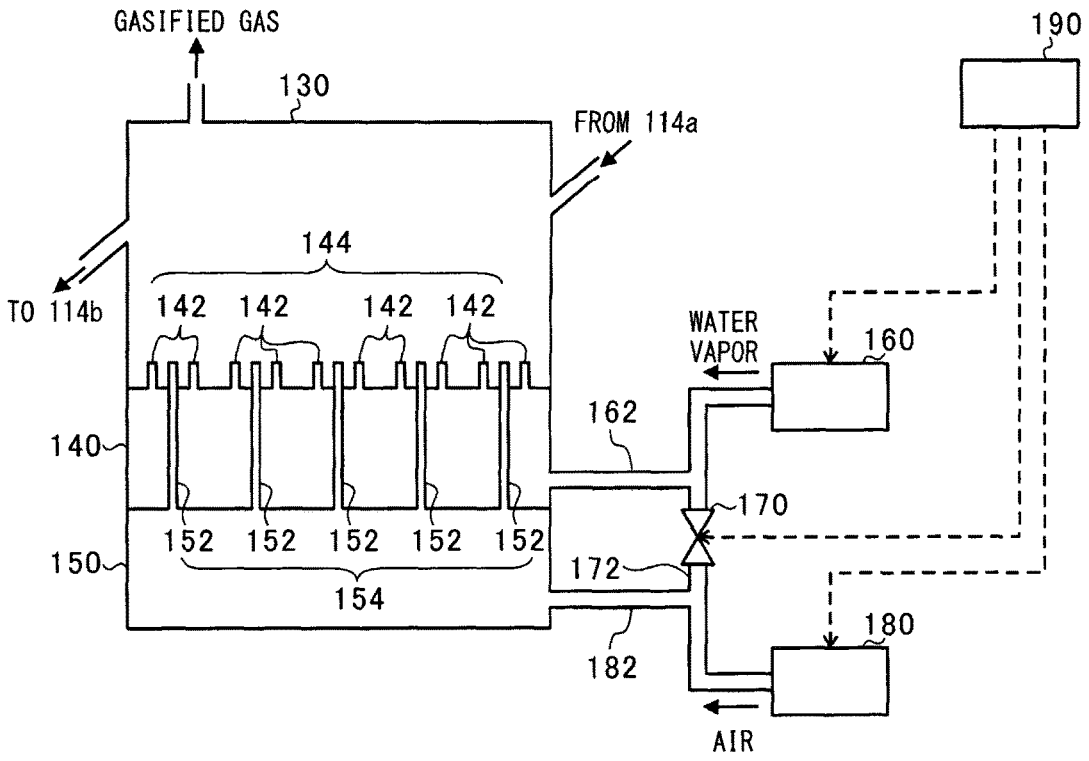
FIG. 2A is a partially enlarged view of a fluidized bed furnace of FIG. 1 and the vicinity thereof for describing a mechanism for reducing the difference between a pressure loss during a start-up operation and a pressure loss during a normal operation.
Figure 2B:
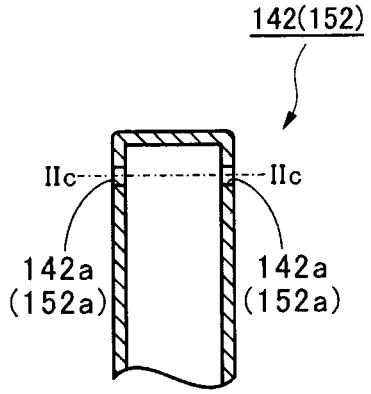
FIG. 2B is a vertical cross-sectional view of a nozzle shown in FIG. 2A.
Figure 2C:
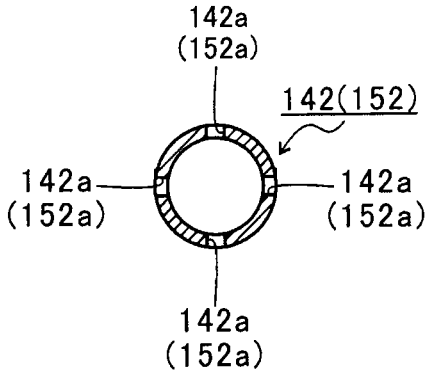
FIG. 2C is a horizontal cross-sectional view of the nozzle cut along the line IIc-IIc of FIG. 2B.

FIGS. 2A to 2C are views for describing the mechanism for reducing the difference between the pressure loss during the start-up operation and the pressure loss during the normal operation, wherein FIG. 2A is a partially enlarged view of the fluidized bed furnace 130 of FIG. 1 and the vicinity of the fluidized bed furnace 130, FIG. 2B is a vertical cross-sectional view of a nozzle 142 or 152, and FIG. 2C is a horizontal cross-sectional view of the nozzle 142 or 152 cut along the line IIc-IIc of FIG. 2B. It should be noted that, in FIGS. 2A and 2C, the fluid medium is omitted in order to facilitate understanding.

As illustrated in FIG. 2A, the first wind box 140 and the second wind box 150 are provided in the lower part of the fluidized bed furnace 130.

The first wind box 140 is provided with a main nozzle group (a first nozzle group) 144 constituted by a plurality of nozzles 142 (10 nozzles are shown here for the sake of convenience of description), and the main nozzle group 144 is disposed inside the fluidized bed furnace 130. As illustrated in FIGS. 2B and 2C, each of the nozzles 142 is provided with a plurality of (here, four) holes (supply holes) 142*a* for supplying a fluidized gas in the circumferential direction at equal intervals, and the fluidized gas is supplied into the fluidized bed furnace 130 passing through the holes 142*a*.

The second wind box 150 is provided with an auxiliary nozzle group (a second nozzle group) 154 that is constituted by a plurality of nozzles 152 (5 nozzles are shown here for the sake of convenience of description), and the auxiliary nozzle group 154 is disposed inside the fluidized bed furnace 130. In the present embodiment, each of the nozzles 152 has holes 152*a* having substantially equal hole diameters as the nozzles 142 (supply holes) formed in the same number as the nozzles 142 (here, four) in the circumferential direction at equal intervals (refer to FIGS. 2B and 2C). Thus, a fluidized gas is supplied into the fluidized bed furnace 130 passing through the holes 152*a* provided in the nozzles 152.

The first supply section 160 is connected with the first wind box 140 through a pipe 162. The first supply section 160 is used only during the normal operation, and supplies water vapor (a fluidized gas) into the fluidized bed furnace 130 only through the main nozzle group 144 according to a control command given by the control section 190 to be described below.

The valve 170 is provided in a communicating tube 172 which communicates the pipe 162 and a pipe 182, and opening and closing thereof are controlled by the control section 190. The control of opening and closing of the valve 170 by the control section 190 will be described below.

The second supply section 180 is configured as, for example a blower, and connected with the first wind box 140 and the second wind box 150 via the pipe 162 and the pipe 182. The second supply section 180 is used only during the start-up operation, and supplies air (a fluidized gas) into the fluidized bed furnace 130 through both the main nozzle group 144 and the auxiliary nozzle group 154 according to a control command given by the control section 190.

The control section 190 is configured with a semiconductor integrated circuit that includes a central processing unit (CPU), reads programs, parameters, and the like from a ROM to operate the CPU, and manages and controls the entire fluidized bed system 100 in cooperation with a RAM which serves as a work area and other electronic circuits. In the present embodiment, the control section 190 controls driving of the combustion furnace 110, driving of the medium separator 112, driving of the first supply section 160, opening and closing of the valve 170, and driving of the second supply section 180.

Specifically, the control section 190 causes a fluidized bed of the fluid medium to be formed inside the fluidized bed furnace 130 by opening or closing the valve 170, controlling the second supply section 180, and supplying air into the fluidized bed furnace 130 through both the main nozzle group 144 and the auxiliary nozzle group 154 or only through the main nozzle group 144 when the start-up operation of the fluidized bed system 100 is performed. In addition, the control section 190 causes a fluidized bed of the fluid medium to be formed inside the fluidized bed furnace 130 by closing the valve 170, controlling the first supply section 160, and supplying water vapor into the fluidized bed furnace 130 only through the main nozzle group 144 when the normal operation of the fluidized bed system 100 is performed.

In other words, the control section 190 controls the first supply section 160, the valve 170, and the second supply section 180 so that the number of nozzles 142 and 152 used during the start-up operation (the total area of the holes 142*a* and 152*a*) is greater than the number of nozzles 142 (the total area of the holes 142*a*) used during the normal operation.

As described above, by setting the total area of the holes 142*a* and 152*a* through which the fluidized gas circulates during the start-up operation to be greater than the total area of the holes 142*a* through which the fluidized gas circulates during the normal operation, it is possible to reduce the difference between the pressure loss during the start-up operation and the pressure loss during the normal operation. For example, with a configuration in which the hole diameter and number of holes 142*a* of the nozzles 142 and the holes 152*a* of the nozzles 152 are set to be substantially equal to each other and the number of nozzles 152 is set to be half that of the nozzles 142, the pressure loss of air of 30° C. can be reduced to about 10 times the pressure loss of water vapor of 500° C.

Thus, even if the nozzles 142 (i.e., the hole diameter and number of holes 142*a*) are designed with reference to water vapor to be supplied during the normal operation, the head of the second supply section 180 can be reduced in comparison to an existing configuration only with the main nozzle group 144, and thus costs required for the second supply section 180 can be reduced.

(Method for Operating the Fluidized Bed System 100)

Figure 3:
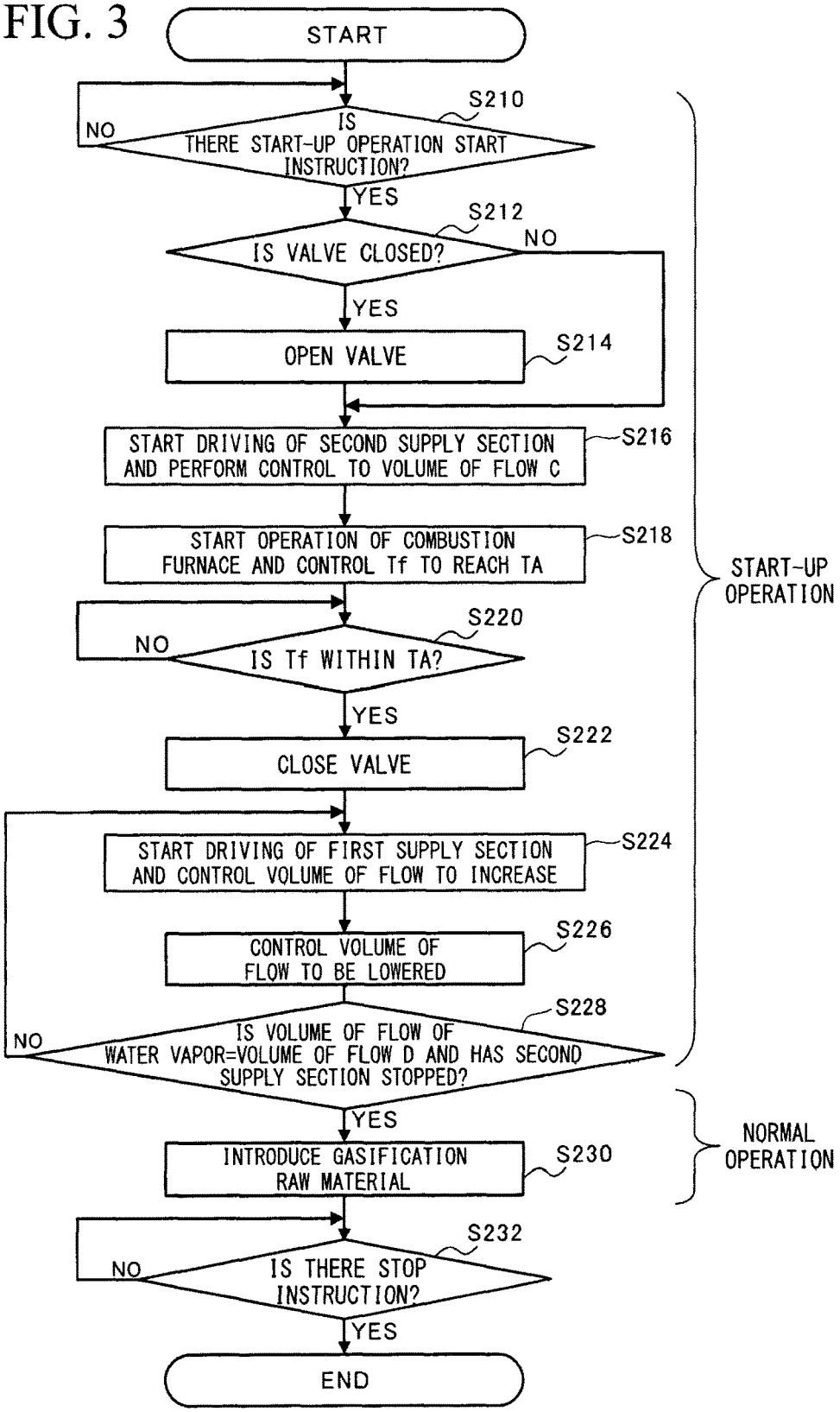
FIG. 3 is a flow chart for describing the flow of a process of a method for operating the fluidized bed system.
Figure 4:
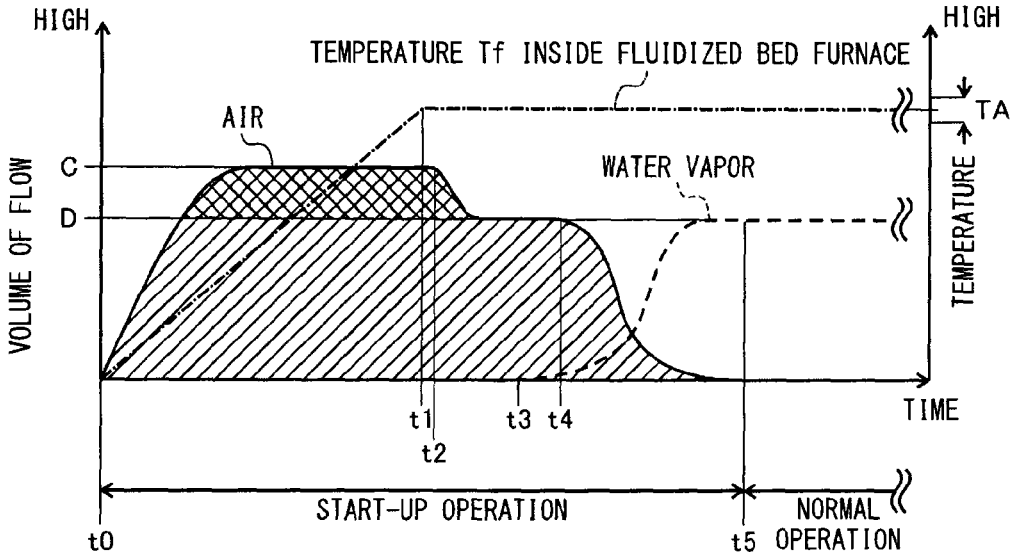
FIG. 4 is a view representing a volume of flow of air supplied into the fluidized bed furnace, a volume of flow of water vapor supplied into the fluidized bed furnace, and a temporal change of temperature inside the fluidized bed furnace.

Next, a method for operating the fluidized bed system 100 (the fluidized bed furnace 130) will be described. FIG. 3 is a flow chart for describing the flow of a process of the method for operating the fluidized bed system 100, and FIG. 4 is a view representing a temporal change of a volume of flow of air supplied into the fluidized bed furnace 130, a volume of flow of water vapor supplied into the fluidized bed furnace 130, and temperature inside the fluidized bed furnace 130.

It should be noted that, in description of the method for operation described above, the fluidized bed system 100 is assumed to be in a stopped state before the start-up operation of the fluidized bed system 100 is started. In addition, in the method for operating the fluidized bed system 100 of the present embodiment, when an operator gives a stop instruction, a process executed at that time is stopped.

When the control section 190 receives an instruction from the operator indicating that a start-up operation is to be started (YES in Step S210), the section determines whether or not the valve 170 is closed (Step S212). It should be noted that, when there is no instruction from the operator indicating that a start-up operation is to be started (NO in Step S210), a stand-by state for an instruction indicating that a start-up operation is to be started is maintained.

When the valve 170 is determined to be closed (YES in Step S212), the control section 190 opens the valve 170 (Step S214). It should be noted that, when the valve 170 is determined to be opened (NO in Step S212), the process proceeds to Step S216.

When the valve 170 is in an open state, the control section 190 starts driving of the second supply section 180 (at time t0 in FIG. 4) and also controls the second supply section 180 so that air of a pre-decided volume of flow C is introduced into the fluidized bed furnace 130 (Step S216). Here, the volume of flow C refers to a value at which a fluidized bed can be formed when air is supplied into the fluidized bed furnace 130 through the main nozzle group 144 and the auxiliary nozzle group 154. Then, air is supplied into the fluidized bed furnace 130 through the main nozzle group 144 and the auxiliary nozzle group 154, and thereby a fluidized bed of the fluid medium is formed in the fluidized bed furnace 130. Accordingly, circulation of the fluid medium is started.

In addition, the control section 190 starts an operation of the combustion furnace 110 and the medium separator 112 (Step S218), and starts heating of the fluid medium. Furthermore, the control section 190 starts measurement of a temperature of the fluid medium inside the fluidized bed furnace 130 using a temperature measuring section that is not illustrated. It should be noted that the control section 190 controls the combustion furnace 110 so that the temperature Tf of the fluid medium inside the fluidized bed furnace 130 reaches a pre-decided temperature range TA. Here, the temperature range TA includes temperatures desired for the fluidized bed furnace 130 (for example, temperatures proper for gasification of a gasification raw material), and the temperature range of, for example, 800° C. to 900° C.

Then, the control section 190 maintains the volume of flow of air supplied by the second supply section 180 to the volume of flow C until the temperature Tf reaches the temperature range TA (NO in S220), and when the temperature Tf is determined to have reached the temperature range TA (YES in Step S220, at the time t1 in FIG. 4), the valve 170 is closed (Step S222, at the time t2 in FIG. 4). As a result, the supply of air to the fluidized bed furnace 130 through the auxiliary nozzle group 154 is stopped. That is to say, in FIG. 4, the supply amount of air indicated with hatching is the supply amount to the fluidized bed furnace 130 through the main nozzle group 144, and the supply amount of air indicated with cross-hatching is the supply amount to the fluidized bed furnace 130 through the auxiliary nozzle group 154.

Next, the control section 190 starts driving of the first supply section 160 (at the time t3 in FIG. 4), and also gradually increases a volume of flow of water vapor supplied by the first supply section 160 (S224). In addition, the control section 190 gradually lowers the volume of flow of the air supplied by the second supply section 180 (Step S226, which is the process from the time t4 to the time t5 in FIG. 4) until the second supply section 180 stops. With the operation described above, while the formation of the fluidized bed is maintained inside the fluidized bed furnace 130, the fluidized gas to be supplied to the fluidized bed furnace 130 can be switched from air to water vapor.

The control section 190 executes the processes of Step S224 and Step S226 described above until the volume of flow of water vapor supplied by the first supply section 160 reaches a predetermined volume of flow D and the second supply section 180 stops (NO in Step S228), and when the volume of flow of water vapor supplied by the first supply section 160 reaches the volume of flow D and the second supply section 180 stops (YES in Step S228, at the time t5 in FIG. 4), a gasification raw material is introduced into the fluidized bed furnace 130 and a normal operation is started (Step S230). That is to say, during the normal operation, water vapor is supplied to the fluidized bed furnace 130 only through the main nozzle group 144. Here, the volume of flow D refers to a value at which a fluidized bed can be formed when water vapor is supplied into the fluidized bed furnace 130 only through the main nozzle group 144.

Then, the control section 190 executes the normal operation until there is a stop instruction from the operator (NO in Step S232), and finishes the operation process when a stop instruction is received (YES in Step S232).

As described above, according to the method for operating the fluidized bed system 100 of the present embodiment, by setting the total area of the holes 142*a* and 152*a* during the period of Step S210 to Step S222 (from the time t0 to the time t2) in the start-up operation from Step S210 to Step S228 described above (from the time t0 to the time t5) to be greater than the total area of the holes 142*a* during the normal operation (Step S230 described above, at the time t5 and thereafter), the difference between the pressure loss of air when the start-up operation of the fluidized bed furnace 130 is performed and the pressure loss of water vapor during the normal operation can be reduced. As a result, the head of the second supply section 180 used during the start-up operation can be reduced. Accordingly, costs required for the second supply section 180 can be reduced.

Second Embodiment: Fluidized Bed System 300

The fluidized bed system 100 in which two supply sections (the first supply section 160 and the second supply section 180) are included has been described in the above-described first embodiment. In a second embodiment, a fluidized bed system 300 in which only one supply section is included will be described.

Figure 5:
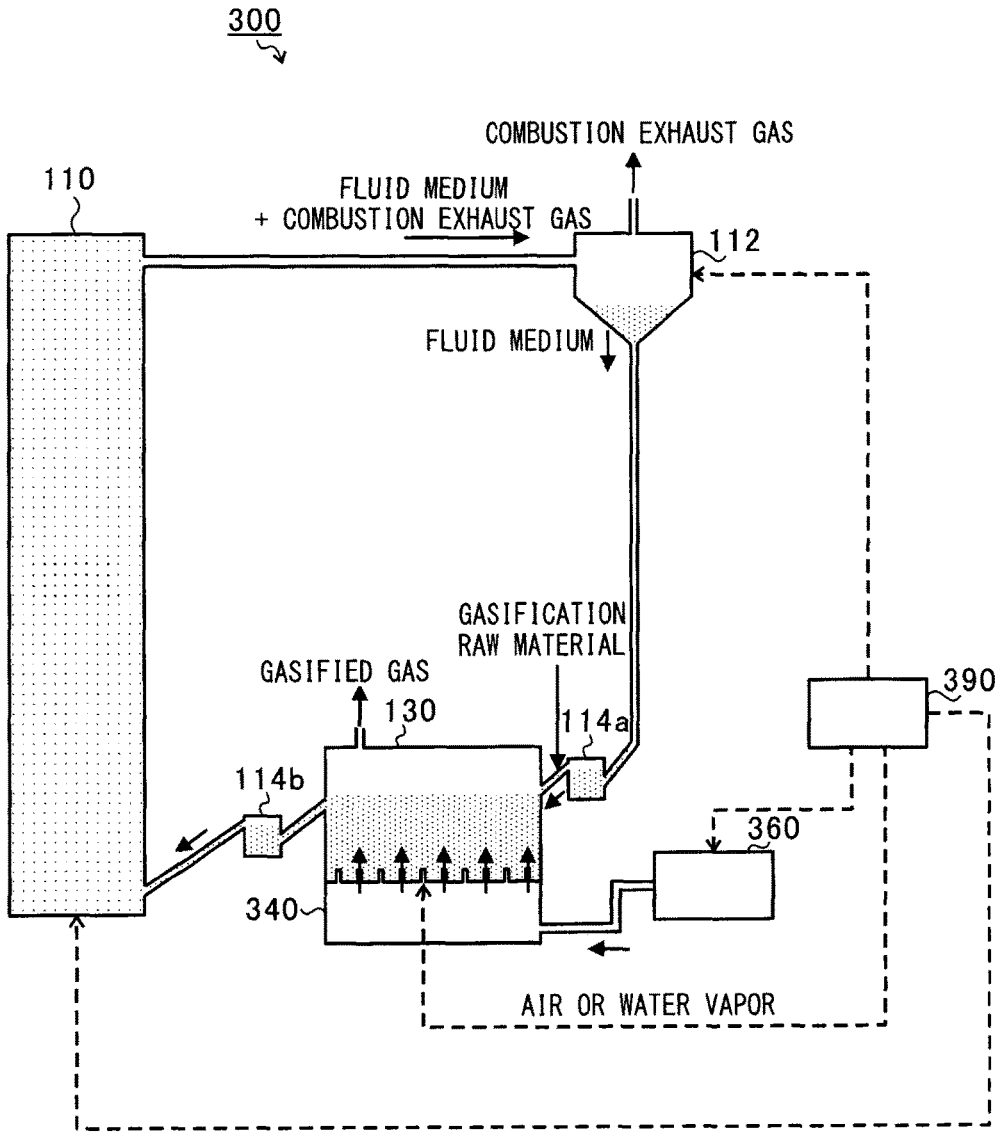
FIG. 5 is a view for describing a specific configuration of a fluidized bed system according to a second embodiment of the present disclosure.
Figure 6A:
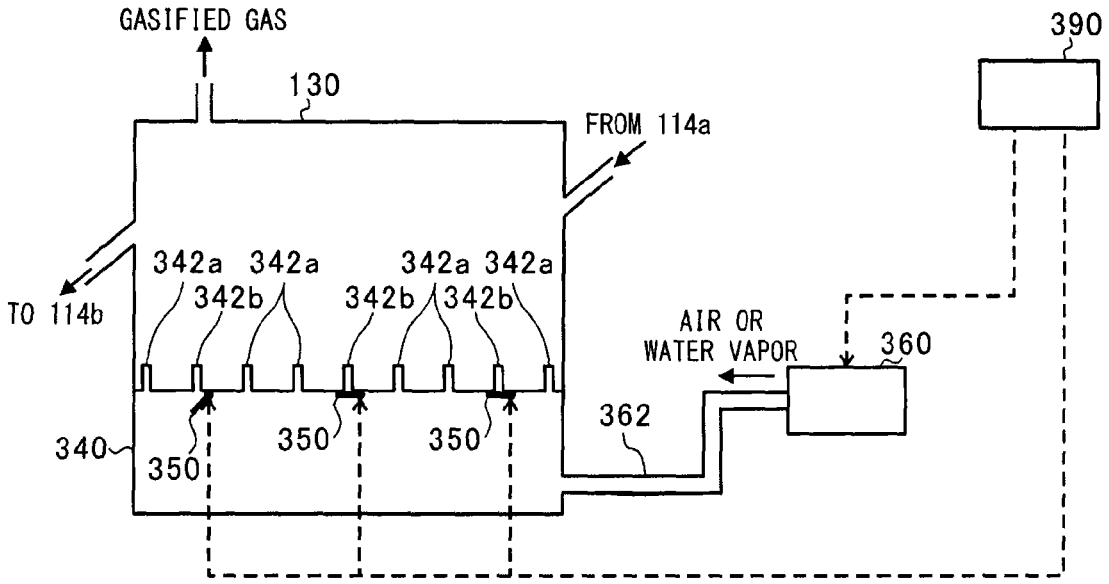
FIG. 6A is a partially enlarged view of a fluidized bed furnace of FIG. 5 and the vicinity thereof for describing a mechanism for reducing the difference between a pressure loss during a start-up operation and a pressure loss during a normal operation.
Figure 6B:
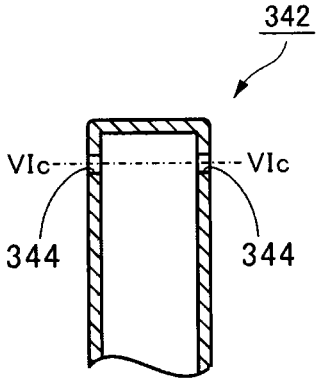
FIG. 6B is a vertical cross-sectional view of a nozzle shown in FIG. 6A.
Figure 6C:
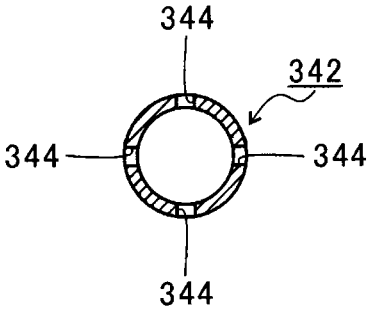
FIG. 6C is a horizontal cross-sectional view of the nozzle cut along the line VIc-VIc of FIG. 6B.

FIG. 5 is a view for describing a specific configuration of the fluidized bed system 300 according to the second embodiment, and FIGS. 6A to 6C are views for describing a mechanism for reducing the difference between a pressure loss during a start-up operation and a pressure loss during a normal operation. Particularly, FIG. 6A is a partially enlarged view of the fluidized bed furnace 130 of FIG. 5 and the vicinity of the fluidized bed furnace 130, FIG. 6B is a vertical cross-sectional view of a nozzle 342, and FIG. 6C is a horizontal cross-sectional view of the nozzle 342 cut along the line VIc-VIc of FIG. 6B. It should be noted that the fluid medium is omitted in FIGS. 6A to 6C in order to facilitate understanding.

As illustrated in FIG. 5, the fluidized bed system 300 is configured to include the combustion furnace 110, the medium separator 112, the loop seals 114*a* and 114*b*, the fluidized bed furnace 130, a wind box 340, a supply section 360, and a control section 390. It should be noted that, in FIG. 5, the flows of substances such as a fluid medium, a gasification raw material, a gasified gas, air, water vapor, a combustion exhaust gas, and the like are indicated by solid-lined arrows, and the flows of signals are indicated by dotted-lined arrows. In addition, the same reference numerals are given to constituent elements that are substantially identical to the constituent elements described in the first embodiment, overlapping description is omitted, and the wind box 340, the supply section 360, and the control section 390 having different functions from those in the first embodiment will be described in detail.

As illustrated in FIG. 6A, the wind box 340 is provided in the lower part of the fluidized bed furnace 130 of the present embodiment. The wind box 340 is provided with a plurality of nozzles 342 (nine nozzles here for the sake of convenience of description) (indicated as 342*a* and 342*b* in FIG. 6A), and the plurality of nozzles 342 are disposed inside the fluidized bed furnace 130. In addition, as illustrated in FIGS. 6B and 6C, four holes 344 for supplying a fluidized gas (supply holes) are provided in each nozzle 342 in the circumferential direction at equal intervals, and the fluidized gas is supplied into the fluidized bed furnace 130 through the holes 344.

In addition, the wind box 340 is provided with opening and closing sections 350 which open (hereinafter referred to as opening) or close (hereinafter referred to as closing) the respective holes 344 of the nozzles 342*b* among the plurality of nozzles 342, and opening and closing thereof are controlled by the control section 390 to be described later. The control of opening and closing of the opening and closing sections 350 by the control section 390 will be described below in detail.

The supply section 360 is connected to the wind box 340 via a pipe 362. According to a control command by the control section 390, the supply section 360 supplies air (a fluidized gas) into the fluidized bed furnace 130 through both the group of nozzles 342*a* and the group of nozzles 342*b*, or supplies water vapor (a fluidized gas) into the fluidized bed furnace 130 through only the group of nozzles 342*a* (specific nozzles fewer in number than the nozzles 342*a* and 342*b* serving as the supply sources of air during a start-up operation).

The control section 390 is configured with a semiconductor integrated circuit that includes a central processing unit (CPU), reads programs, parameters, and the like from a ROM to operate the CPU, and manages and controls the entire fluidized bed system 300 in cooperation with a RAM serving as a work area and other electronic circuits. In the present embodiment, the control section 390 controls driving of the combustion furnace 110, driving of the medium separator 112, opening and closing of the opening and closing sections 350, and driving of the supply section 360.

Specifically, when the start-up operation of the fluidized bed system 300 is performed, the control section 390 controls the opening and closing sections 350 to open or close the holes of the group of nozzles 342*b*, and also drives the supply section 360 to supply air into the fluidized bed furnace 130 through both the group of nozzles 342*a* and the group of nozzles 342*b* or through only the group of nozzles 342*a*, thereby causing a fluidized bed of the fluid medium to be formed inside the fluidized bed furnace 130. In addition, when the normal operation of the fluidized bed system 300 is performed, the control section 390 controls the opening and closing sections 350 to close the holes of the group of nozzles 342*b*, and also drives the supply section 360 to supply water vapor into the fluidized bed furnace 130 through only the group of nozzles 342*a*, thereby causing a fluidized bed of the fluid medium to be formed inside the fluidized bed furnace 130.

In other words, the control section 390 controls opening and closing of the opening and closing sections 350 so that the number of the group of nozzles 342*a* and the group of nozzles 342*b* (the total area of the holes 344) that are used during the start-up operation is greater than the number of the group of nozzles 342*a* (the total area of the holes 344) that are used during the normal operation. That is to say, in the present embodiment, the opening and closing sections 350 and the control section 390 configures a control mechanism for reducing the difference between the pressure loss during the start-up operation and the pressure loss during the normal operation.

As described above, by setting the total area of the holes 344 through which the fluidized gas circulates during the start-up operation to be greater than the total area of the holes 344 through which the fluidized gas circulates during the normal operation, the difference between the pressure loss during the start-up operation and the pressure loss during the normal operation can be reduced.

Third Embodiment: Fluidized Bed System 400

In the second embodiment described above, the fluidized bed system 300 which reduces the difference between the pressure loss during the start-up operation and the pressure loss during the normal operation by opening and closing the holes 344 of the nozzles 342*b* using the opening and closing sections 350 has been described. The difference between the pressure loss during the start-up operation and the pressure loss during the normal operation, however, can be reduced using another configuration.

Figure 7:
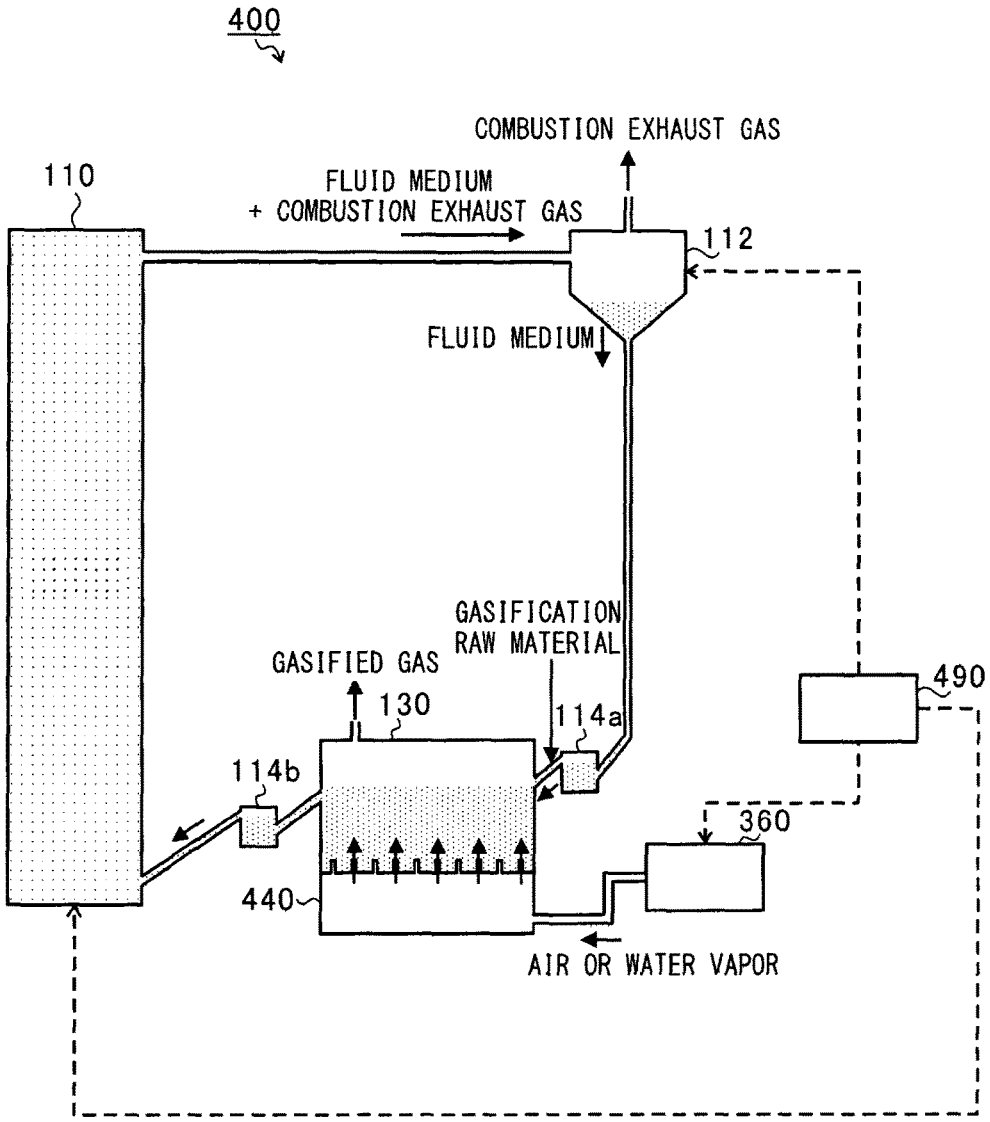
FIG. 7 is a view for describing a specific configuration of a fluidized bed system according to a third embodiment of the present disclosure.
Figure 8A:
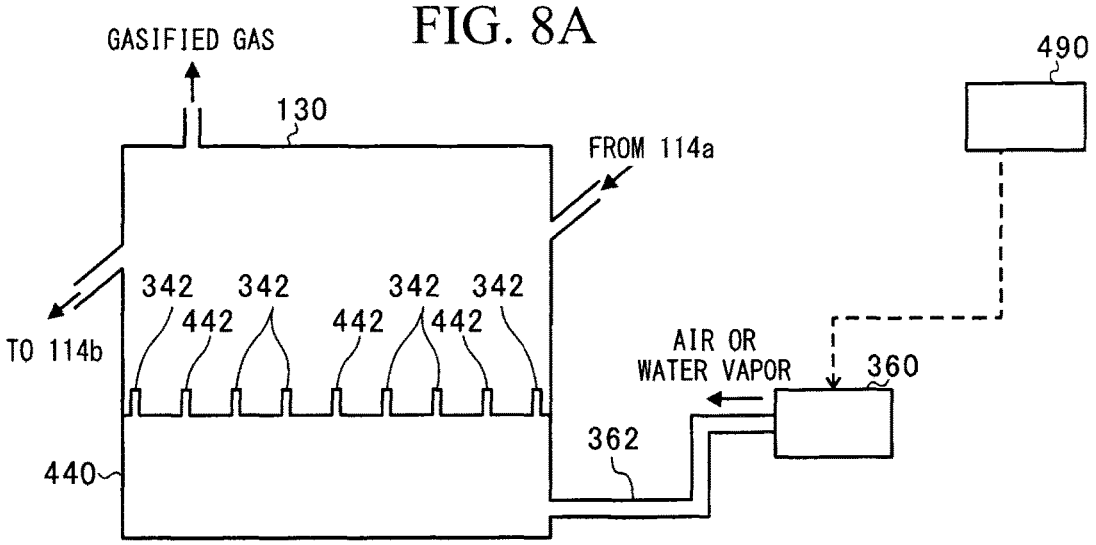
FIG. 8A is a partially enlarged view of a fluidized bed furnace of FIG. 7 and the vicinity thereof for describing a mechanism for reducing the difference between a pressure loss during a start-up operation and a pressure loss during a normal operation.
Figure 8B:
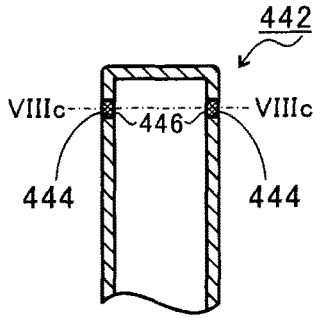
FIG. 8B is a vertical cross-sectional view of a nozzle shown in FIG. 8A.
Figure 8C:
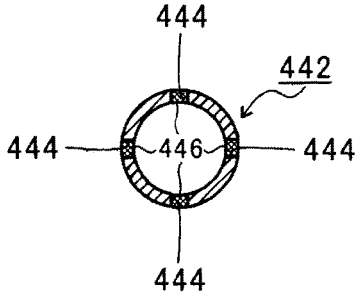
FIG. 8C is a horizontal cross-sectional view of the nozzle cut along the line VIIIc-VIIIc of FIG. 8B.

FIG. 7 is a view for describing a specific configuration of a fluidized bed system 400 according to a third embodiment, and FIGS. 8A to 8C are views for describing a mechanism for reducing the difference between a pressure loss during a start-up operation and a pressure loss during a normal operation. Particularly, FIG. 8A is a partially enlarged view of the fluidized bed furnace 130 of FIG. 7 and the vicinity of the fluidized bed furnace 130, FIG. 8B is a vertical cross-sectional view of a nozzle 442, and FIG. 8C is a horizontal cross-sectional view of the nozzle 442 cut along the line VIIIc-VIIIc of FIG. 8B. It should be noted that the fluid medium is omitted in FIGS. 8A to 8C in order to facilitate understanding.

As illustrated in FIG. 7, the fluidized bed system 400 is configured to include the combustion furnace 110, the medium separator 112, the loop seals 114*a* and 114*b*, the fluidized bed furnace 130, a wind box 440, the supply section 360, and a control section 490. It should be noted that, in FIG. 7, the flows of substances such as a fluid medium, a gasification raw material, a gasified gas, air, water vapor, a combustion exhaust gas, and the like are indicated by solid-lined arrows, and the flows of signals are indicated by dotted-lined arrows. In addition, the same reference numerals are given to constituent elements that are substantially identical to the constituent elements described in the first and second embodiments above, overlapping description is omitted, and the wind box 440 and the control section 490 having different functions from those in the first and second embodiments will be described in detail.

As illustrated in FIG. 8A, the wind box 440 is provided in the lower part of the fluidized bed furnace 130 of the present embodiment. The wind box 440 is provided with a group of a plurality of nozzles 342 and 442 (which are nine nozzles herein for the sake of convenience of description), and the group of the plurality of nozzles 342 and 442 is disposed inside the fluidized bed furnace 130. In addition, as illustrated in FIGS. 8B and 8C, each nozzle 442 is provided with four holes (supply holes) 444 for supplying a fluidized gas in the circumferential direction at equal intervals, and the fluidized gas is supplied into the fluidized bed furnace 130 through the holes 444.

In addition, holes 444 are each provided with a filter 446 with a function of allowing air to pass therethrough and preventing passage of water vapor.

The control section 490 is configured with a semiconductor integrated circuit that includes a central processing unit (CPU), reads programs, parameters, and the like from a ROM to operate the CPU, and manages and controls the entire fluidized bed system 400 in cooperation with a RAM serving as a work area and other electronic circuits. In the present embodiment, the control section 490 controls driving of the combustion furnace 110, driving of the medium separator 112, and driving of the supply section 360.

Specifically, the control section 490 drives the supply section 360 to supply air to the wind box 440 when the start-up operation of the fluidized bed system 400 is performed. In this case, since the filters 446 provided in the group of nozzles 442 have the function of allowing air to pass therethrough, air can be supplied into the fluidized bed furnace 130 not only through the group of nozzles 342 but also through the group of nozzles 442, and thus a fluidized bed of the fluid medium can be formed inside the fluidized bed furnace 130 with the supplied air.

On the other hand, when the normal operation of the fluidized bed system 400 is performed, if the control section 490 drives the supply section 360 to supply water vapor to the wind box 440, the water vapor will not be supplied into the fluidized bed furnace 130 from the holes 444 of the group of nozzles 442 because the filters 446 provided in the group of nozzles 442 have the function of preventing passage of water vapor. Therefore, the water vapor is supplied into the fluidized bed furnace 130 only through the group of nozzles 342, and thereby a fluidized bed of the fluid medium is formed inside the fluidized bed furnace 130.

In other words, in the present embodiment, the filters 446 and the control section 490 configure a control mechanism for reducing the difference between the pressure loss during the start-up operation and the pressure loss during the normal operation.

As described above, with the simple configuration in which the filters 446 are each provided in the respective holes 444 of the nozzles 442, the total area of the holes 444 through which the fluidized gas circulates during the start-up operation can be set to be greater than the total area of the holes 444 through which the fluidized gas circulates during the normal operation, and thus the difference between the pressure loss during the start-up operation and the pressure loss during the normal operation can be reduced.

Although exemplary embodiments of the present disclosure have been described so far with reference to the accompanying drawings, it is needless to say that the present disclosure is not limited to these embodiments. It is obvious that a person skilled in the art can conceive of various modified or altered examples within the scope described in the claims, which would clearly be regarded as falling within the technical range of the present disclosure.

For example, in the embodiments described above, the case in which the gas supplied to the fluidized bed furnace 130 during the start-up operation is air and the gas supplied to the fluidized bed furnace 130 during the normal operation is water vapor has been described as an example. However, there is no limit to the type of gas to be supplied to the fluidized bed furnace 130, and an inert gas, for example, nitrogen or the like, may be introduced instead of water vapor or air. In addition, the same gas may be supplied to the fluidized bed furnace 130 during the start-up operation and the normal operation. For example, even with the same gas, a pressure loss at the supply holes is different when temperature thereof is different. For this reason, using the configurations described above, the difference between a pressure loss during a start-up operation and a pressure loss during a normal operation can be reduced.

In addition, the configuration in which the fluidized bed systems 100, 300, and 400 have the combustion furnace 110 has been described in the above-described embodiments; however, the combustion furnace 110 is an essential configuration, and the fluid medium may be heated using a heater or the like.

In addition, the case in which the hole diameter and the number of holes 142*a*, 152*a*, 344, and 444 of the nozzles 152, 342*b*, and 442 that are used only during the start-up operation and the nozzles 142, 342*a*, and 342 that are used during the start-up operation and the normal operation are substantially equal to each other has been described as an example in the embodiments above; however, the hole diameters may be different and the numbers of holes may be different. In addition, the case in which the holes are formed in the circumferential direction of the nozzles at equal intervals has been described; however, the holes need not necessarily be formed in the circumferential direction at equal intervals.

In addition, the main nozzle group 144, the auxiliary nozzle group 154, the group of nozzles 342*a*, the group of nozzles 342*b*, the group of nozzles 342, and the group of nozzles 442 are constituted with a plurality of nozzles in the embodiments described above; however, they may be constituted with one nozzle.

In addition, the case in which, when the gas to be supplied to the fluidized bed furnace 130 is switched from air to water vapor, the control section 190 controls the first supply section 160 and the second supply section 180 so that the volume of flow of water vapor gradually increases while the volume of flow of air is reduced has been described as an example in the first embodiment described above. However, when the gas to be supplied to the fluidized bed furnace 130 is switched from air to water vapor, the control section 190 may first stop the supply of air to the fluidized bed furnace 130, and then start the supply of water vapor.

It should be noted that the respective steps of the method for operating the fluidized bed system (fluidized bed furnace) of the present specification do not necessarily perform processes in a time series manner as described in the flow chart, and may perform the processes in a parallel manner.

It should be noted that the supply of a fluidized gas into the fluidized bed furnace using the plurality of nozzles groups is also described in Patent Document 2 described above. However, Patent Document 2 is different from the present disclosure in that a diaphragm portion is provided in each blow-out nozzle for the purpose of increasing a pressure loss and it does not have a configuration for supplying the fluidized gas into the fluidized bed furnace only through one of the plurality of nozzles groups.

In addition, the control of the supply amount of the fluidized gas into the fluidized bed furnace from the nozzles is also described in Patent Document 3 described above.

However, Patent Document 3 is different from the present disclosure in that the nozzles are not divided into a plurality of nozzles groups and different control is not performed with respect to the nozzle groups.

INDUSTRIAL APPLICABILITY

The present disclosure can be used for a fluidized bed system in which a fluid medium forms a fluidized bed and a method for operating a fluidized bed furnace.

The invention claimed is:

1. A method for operating a fluidized bed furnace, wherein, when a start-up operation of a fluidized bed furnace that contains a fluid medium is performed, air is supplied through a plurality of nozzles that are provided inside the fluidized bed furnace having holes into the fluidized bed furnace to form a fluidized bed of the fluid medium inside the fluidized bed furnace, and wherein, when a normal operation of the fluidized bed furnace is performed, water vapor is supplied through, among the plurality of nozzles, specific nozzles that are fewer in number than the nozzles that serve as a supply source of the air during the start-up operation into the fluidized bed furnace to form the fluidized bed of the fluid medium inside the fluidized bed furnace.

2. A method for operating a fluidized bed furnace, wherein, when a start-up operation of the fluidized bed furnace that contains a fluid medium is performed, air is supplied into the fluidized bed furnace through both a first nozzle group that is provided inside the fluidized bed furnace and constituted by one or a plurality of nozzles having holes, and a second nozzle group that is a nozzle group different from the first nozzle group, is provided inside the fluidized bed furnace, and is constituted by one or a plurality of nozzles having holes to form a fluidized bed of the fluid medium inside the fluidized bed furnace, and wherein, when a normal operation of the fluidized bed furnace is performed, water vapor is supplied through only one of the first nozzle group and the second nozzle group into the fluidized bed furnace to form the fluidized bed of the fluid medium inside the fluidized bed furnace.

3. A fluidized bed system comprising:

a fluidized bed furnace that contains a fluid medium;

a plurality of nozzles that are provided inside the fluidized bed furnace and have holes for supplying a gas;

a supply section that supplies the gas into the fluidized bed furnace through the plurality of nozzles; and a control mechanism for forming a fluidized bed of the fluid medium inside the fluidized bed furnace by supplying air into the fluidized bed furnace during a start-up operation through the plurality of nozzles, and for forming the fluidized bed of the fluid medium inside the fluidized bed furnace by supplying water vapor into the fluidized bed furnace during a normal operation through, among the plurality of nozzles, specific nozzles that are fewer in number than the nozzles that serve as a supply source of the air during the start-up operation.

4. The fluidized bed system according to claim 3, wherein the control mechanism is configured to include an opening and closing section that opens or closes holes of the specific nozzles, and a control section that controls the opening and closing section during the start-up operation to open the holes of the specific nozzles and controls the opening and closing section during the normal operation to close the holes of the specific nozzles.

5. The fluidized bed system according to claim 3, wherein the control mechanism is configured to include filters provided in holes of the specific nozzles among the plurality of nozzles, and wherein the filters has a function of allowing air to pass through the filters and preventing passage of water vapor.

6. A fluidized bed system comprising:

a fluidized bed furnace that contains a fluid medium;

a first nozzle group that is provided inside the fluidized bed furnace and constituted by one or a plurality of nozzles having holes for supplying a gas;

a second nozzle group that is a nozzle group different from the first nozzle group, is provided inside the fluidized bed furnace, and is constituted by one or a plurality of nozzles having holes for supplying a gas;

a first supply section that supplies the gas into the fluidized bed furnace through one of the first nozzle group and the second nozzle group;

a second supply section that supplies the gas into the fluidized bed furnace through both the first nozzle group and the second nozzle group; and a control section that controls the second supply section during a start-up operation to supply the gas into the fluidized bed furnace to form a fluidized bed of the fluid medium inside the fluidized bed furnace, and stops the supply of the gas by the second supply section and controls the first supply section during a normal operation to supply the gas into the fluidized bed furnace to form the fluidized bed of the fluid medium inside the fluidized bed furnace, wherein the gas supplied by the first supply section is water vapor and the gas supplied by the second supply section is air.

* * * * *